United States Patent [19]

Wheeler

[11] 4,327,795

[45] May 4, 1982

[54] WINDOW CASEMENT

[76] Inventor: Everett T. Wheeler, 293 Mount Vernon St., Lawrence, Mass. 01843

[21] Appl. No.: 224,143

[22] Filed: Jan. 12, 1981

[51] Int. Cl.[3] ..... E06B 3/32

[52] U.S. Cl. ..... 160/98; 160/107; 160/236; 49/64

[58] Field of Search ..... 160/87–89, 160/98, 107, 108, 236; 49/64, 65

[56] References Cited

U.S. PATENT DOCUMENTS

| | | | |
|---|---|---|---|
| 1,639,474 | 8/1927 | Whitmore | 160/236 |
| 2,155,985 | 4/1939 | Waterman | 160/236 |
| 2,170,777 | 8/1939 | Simon | 160/107 |
| 2,227,238 | 12/1940 | Warren | 160/89 |
| 2,490,295 | 12/1949 | Fisher | 160/107 |
| 2,560,397 | 7/1951 | Tims | 160/98 |
| 2,651,085 | 9/1953 | Kopp | 49/64 |
| 2,855,039 | 10/1958 | Gross | 160/236 |
| 3,089,540 | 5/1963 | Schwartz | 160/98 |
| 3,292,309 | 12/1966 | Horner | 49/64 |
| 4,060,119 | 11/1977 | Nohmura et al. | 160/88 |

*Primary Examiner*—Peter M. Caun

[57] ABSTRACT

A window casement designed to be attached to a window frame outside the window sash operative on the one hand to serve as a storm window and on the other hand to provide supplemental heating during the winter and cooling during the summer.

28 Claims, 11 Drawing Figures

WINDOW CASEMENT

BACKGROUND OF THE INVENTION

The primary purpose of the invention as herein disclosed is threefold, to wit, to provide a structure which serves at times as a storm window and as a source of supplemental heat, especially during the winter months, and as an awning for cooling the home during the summer months.

Structures designed to provide for heating and ventilating homes by means of the sun's rays are shown in such patents as Morse U.S. Pat. No. 246,626; Thompson U.S. Pat. No. 2,931,578; Strand U.S. Pat. No. 4,069,809; Haberthier U.S. Pat. No. 4,111,183; and Johnston U.S. Pat. No. 3,875,925. However, none of these structures provides the multi-purpose feature of the instant invention.

SUMMARY OF THE INVENTION

As herein illustrated, the invention comprises in combination with a window embodying a window frame and upper and lower sash, means defining a casement hingedly connected at its upper end to the window frame for swinging movement from a position of engagement with the window frame to a position standing angularly away from the window frame, said casement being comprised of a light-transmitting material and having at its upper end an opening parallel to the top of the window so that it will be in communication with the interior of the house when the upper sash is lowered and means in the casement positionable for on the one hand to absorb heat from the sun and on the other hand to reflect heat from the sun. The latter means when positioned to absorb heat may at the same time be further positioned to admit light and when positioned to reflect light to be further positioned to admit light and on the one hand when positioned to admit heat to exclude light and when positioned to reflect heat to exclude light. The aforesaid means has a heat-absorbing surface on one side and a heat reflecting surface on the other side and is reversible and in one form comprises spaced, parallel slats supported for rotation about a horizontal axis, each slat having on one surface a heat-absorbing surface and on its other surface a heat-reflective surface. In the preferred form, the slats are hollow tubes with thin flat fins along their opposite sides. Optionally, the slats may be flat blades.

There is means positioned marginally of the casement at the inner side providing a seal between the window frame and the casement when the latter is in engagement with the frame; supporting arms for supporting the casement at an angle standing away from the window frame; and means defining skirts attached, respectively, to the window frame and the back side of the casement extendible by movement of the casing to an angular position relative to the window frame to form in conjunction with the window frame and the casement an enclosure open at the bottom. The skirts are detachably attached to the window frame and casement. The casement is comprised of spaced, parallel front and back walls; spaced, parallel top and bottom walls; and spaced, parallel side walls which define in conjunction a closed chamber which functions when the casement is engaged with the frame to provide a substantially dead air space so that the casement becomes operative as an effective storm window. At the bottom of the casement there is a vent opening and a closure therefor to provide for ventilation when the casement is positioned at an angle to the window and functioning either for the purpose of warming or cooling the house. Optionally, a roller curtain may be substituted for the slats comprised of a flexible material coated on one side with an absorbent coating and on the other side with a reflective coating supported in the casing so as to enable reversing it.

The invention will now be described in greater detail with reference to the accompanying drawings, wherein.

Figure 1:
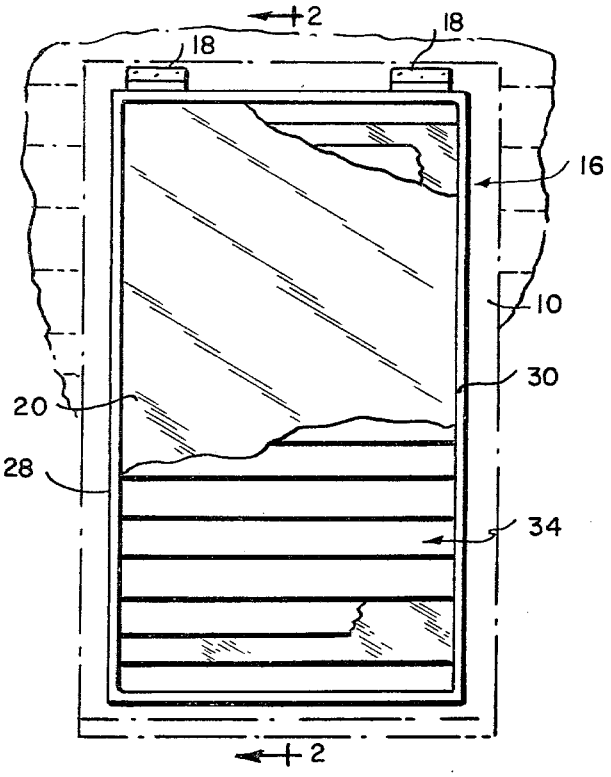
FIG. 1 is a front elevation of a window frame, the latter being shown in dot and dash lines with the casement of the invention applied thereto and with portions broken away to show the slats interiorly thereof.
Figure 2:
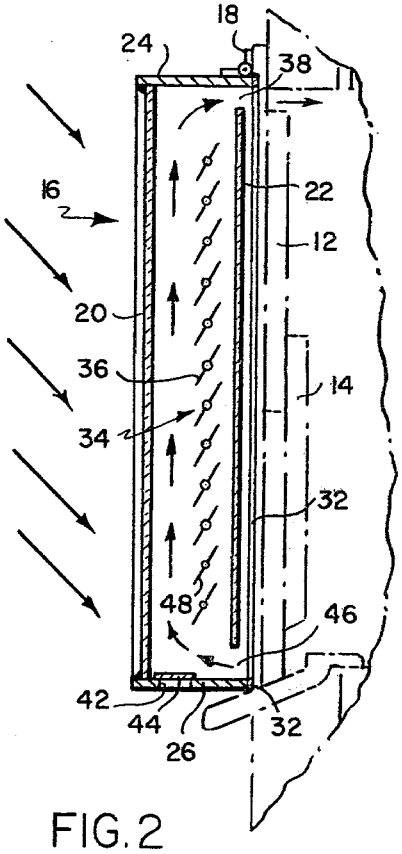
FIG. 2 is a section taken on the line 2—2 of FIG. 1 showing the casement supported in engagement with the window frame and showing the windlow sash in dot and dash lines with the upper sash pulled down.

Referring to the drawings, FIGS. 1 and 2, there is shown in dot and dash lines a window frame 10 including upper and lower window sashes 12 and 14.

The device of this invention which has the multiple or threefold purpose of serving as a storm window, or a heating device for supplying supplemental heat from the sun, or as a cooling device for cooling the house in the summer, comprises a casing 16 hingedly connected by means of hinges 18—18 at the top to the window frame. The casing 16 is of substantially rectangular, horizontal and vertical section comprising spaced, parallel front and back panels 20 and 22, top and bottom panels 24 and 26, and side panels 28 and 30. The panels are comprised of sheet material which will transmit light and may be either translucent or transparent and may be comprised either of glass or plastic. The casing is dimensioned to correspond substantially to the width and length of the window opening and there is provided at the inner side peripherally thereof a flexible material 32, for example, a sealing material for providing a seal between the casement and the window frame when the casement is in enggement with the window frame as shown in FIG. 2. In this position, the casement, because of its double wall construction, without any other accoutrements, functions as a storm window.

The casement, however, is designed not only to serve as a storm window, but also on the one hand to serve as a means for providing supplemental heat to the house during the winter months and as an awning to provide for cooling during the summer months. For the purpose of supplying supplement heat to the house in the winter time, the casement is provided with means for absorbing heat from the sun and supplying the heat to the interior of the house through the top of the window by lowering the upper sash 12 as shown in FIG. 2. The means for absorbing heat comprises a plurality of spaced, parallel slats 34 like the slats of a venetion blind arranged to be rotated angularly about horizontal axes so as to incline their surfaces 36 upwardly and rearwardly within the casing and these inclined surfaces are, for this purpose, coated with a coating of heat-absorbent material 36*a*, for example, black paint. The back panel 22 of the casing contains an opening 38 at the top so that with the slats positioned as shown in FIG. 2, heat absorbed by the surfaces of the slots will rise by convection through the spaces between the slats upwardly to the top of the casing and will pass through the opening 38 into the house through the opening provided by the lowered upper sash 12. In the position shown, the slats not only provide for supplying supplemental heat to the house, but also to permit light to enter. It is possible, of course, to so position the slats that the absorbent side will absorb heat and direct it upwardly within the casing through the opening 38 into the house with the slats entirely closed so as to exclude the light.

Figure 3:
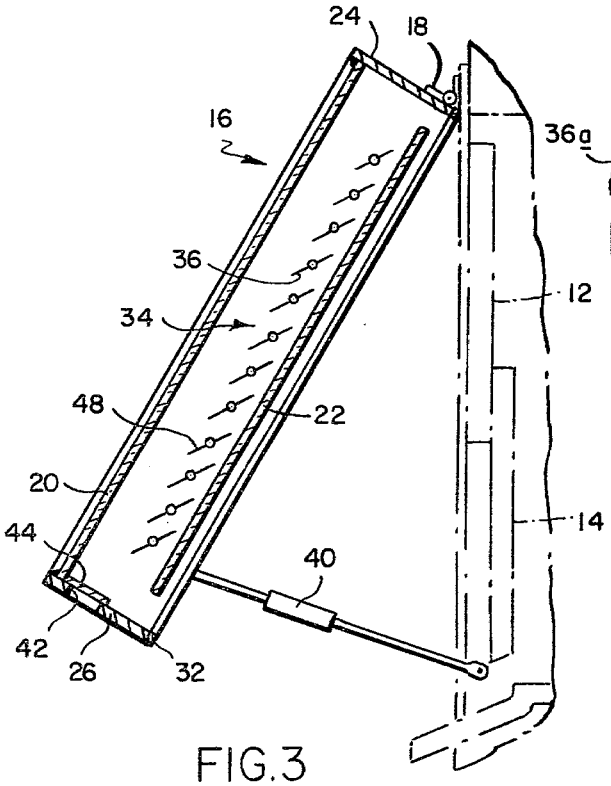
FIG. 3 is a section of the casement taken on the line 2—2 of FIG. 1 with the casement supported at an angle to the window frame.

The casement as shown in FIG. 3 is provided with supporting arms 40—40, one at either side, which are telescopically adjustable to move the casing outwardly from the window frame so that it stands at an angle thereto to enable taking full advantage of the sun's rays both during the winter months when the sun's rays are nearly horizontal and the summer months when the sun's rays are nearly vertical.

Figure 8:
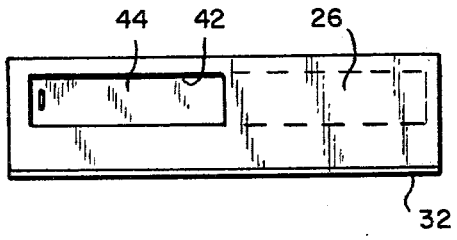
FIG. 8 is a bottom view of the casing showing a vent opening.

As shown in FIGS. 1, 2 and 8, the casing has a vent opening 42 at the bottom and a slidable closure 44 which enables supplying fresh air from outside into the casing where it is warmed by contact with the absorptive surfaces of the slats before it enters the house at the top of the casing through the lowered upper sash. To promote circulation of fresh air within the house, the lower end of the back panel 22 may be provided with an opening 46 and the lower sash 14 raised so that air from the house can circulate through the opening at the bottom of the lower sash through the casing and upwardly therein through the top opening into the house through the lowered upper sash.

For the purpose of cooling the house in its function as a blind or awning, the slats are rotated 180° to present the opposite side surfaces 48, FIG. 3, outwardly and these sides are coated with a reflective coating 48*a* so that the sun impinging upon them is reflected outwardly. The casing may be used, as shown in FIG. 2, in engagement with the window frame or disposed at an angle thereto as shown in FIG. 3 and, in either event, the slats 34 may be disposed at an angle to each other to both reflect heat and to admit light or to reflect heat and prevent entrance of light.

Figure 4:
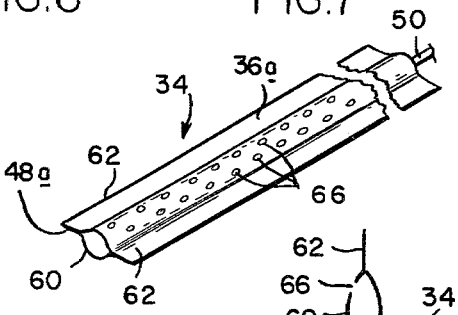
FIG. 4 is a fragmentary perspective view of the preferred form of slat.
Figure 5:
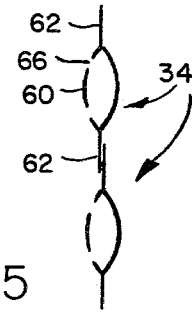
FIG. 5 is a fragmentary end view of two adjacent slats of the kind shown in FIG. 4 showing their overlapping relation when closed.

The preferred form of slat 34 is shown in FIGS. 4 and 5 comprising a thin-walled, hollow, tubular structure 60 provided along its opposite longitudinal sides with flat fins 62—62. The slats may be constructed of sheet metal tubing with flat sheet metal fins attached to its opposite edges. Desirably, the tubing is flattened as shown in FIG. 5 to make it somewhat oval or elliptical in cross section and the fins are attached to its narrower sides. As previously indicated, one side of each slat is coated with a heat-absorbent material 36*a* and the other side with heat-reflective material 48*a*. The heat-absorbent side contains a plurality of perforations 66. The tubular structure absorbs heat from the sun and radiates it within the casing. The slats are supported for rotation about horizontal axes on pins 50—50 at their opposite ends, FIG. 9, the pins at one end having fixed thereto sprockets 52. A chain 54 is provided for rotating the sprockets and, hence, reversing the position of the slats. Controlled heating or controlled cooling can be obtained by properly positioning the slats about their horizontal axes to present alternately their reflective and heat-absorptive surfaces outwardly.

Figure 6:
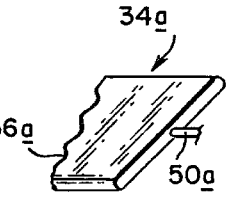
FIG. 6 is a perspective of an end portion of a flat slat showing one side coated with a reflective coating.
Figure 7:
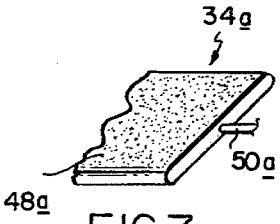
FIG. 7 is a perspective of an end portion of the slat shown in FIG. 6 with the other side coated with a heat-absorbent coating.
Figure 9:
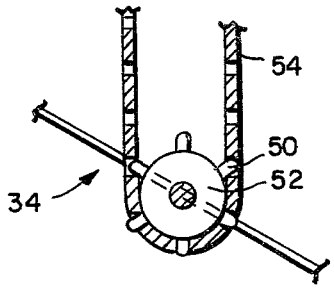
FIG. 9 is a fragmentary view showing chain and sprocket means for reversing the positions of the slats.

Optionally, flat slats 34*a* may be employed as shown in FIGS. 6 and 7 provided with reflective surfaces 48*a* and absorptive surfaces 36*a*. The slats 34*a* are mounted by means of pins 50*a—50a* at their opposite ends in the same way as the slats 34 and rotated by means of sprocket and chain means as shown in FIG. 9.

Figure 10:
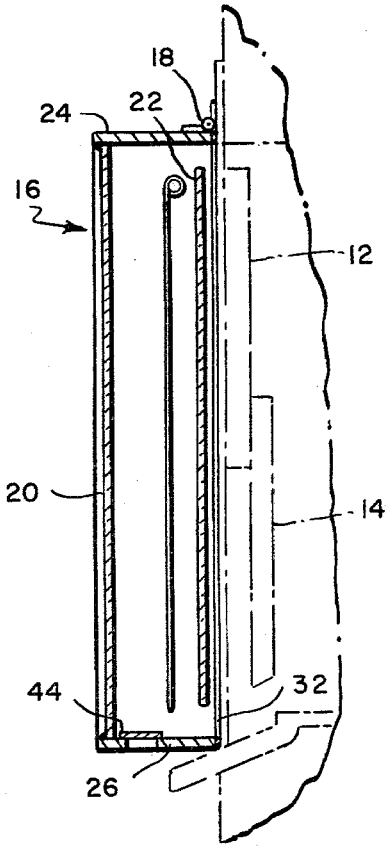
FIG. 10 is a section of the casement with a roller curtain substituted for the slats.
Figure 11:
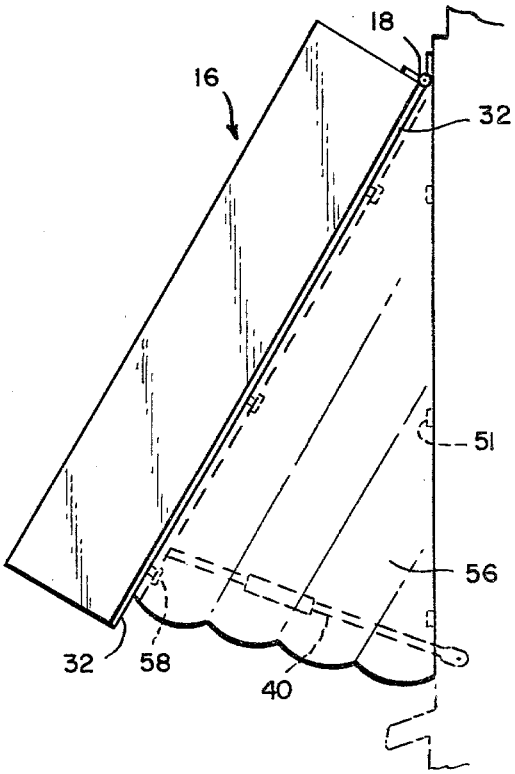
FIG. 11 is an elevation showing the casing disposed at an angle to the window frame, with skirts fastened between the casement and window frame.

In place of the slats 34, there may be substituted a conventional roller curtain 60, FIG. 10, supported at the top of the casing for unrolling from the top to the bottom, one surface of which is covered with an absorptive coating such as black paint and the other surface of which is coated with a reflective coating such as aluminum paint, the curtain roller being so mounted that it may be reversed. The curtain has the advantage that the window may be partially closed to admission of light and open as to the remainder thereof to the admission of light.

In the Figures, FIGS. 2 and 3, the arrows indicate the direction of the sun falling upon the outer panel of the casing and the direction of flow of the heat upwardly in the casing and into the house.

While as indicated before the casement provides a very satisfactory storm window without the further addition of the slats, the latter in conjunction with the casing supplements its function in the capacity of a storm window when the slats are disposed with their reflective sides outwardly by reflecting cold away from the window and when entirely closed providing a continuous shield which keeps out the cold.

When the casement is disposed at an angle to the window frame as an awning, removable side skirts 56 of somewhat triangular configuration are desirably detachably attached at their opposite edges, respectively, to the window frame and to the rear side of the casement by means of snap fasteners 58 or similar fastening means to form in conjunction with the window frame and the casement an enclosure open at the bottom. The skirts 56 are comprised of a flexible yet sturdy and durable material and when not being used are detached and stored away.

The casement may be comprised of sheets of plastic or sheets of glass or a combination of glass and plastic so as to afford a maximum entry of both heat and light. However, if desired, only the front and back panels of the casement are made transparent or translucent, the top, bottom and side walls being comprised of an opaque material, for example, a wooden frame designed to receive the front and back panels and to hold them in spaced, parallel relation.

It should be understood that the present disclosure is for the purpose of illustration only and includes all modifications or improvements which fall within the scope of the appended claims.

What is claimed is:

1. In combination with a window embodying a window frame and upper and lower sash, means defining a casement hingedly connected at its upper end to the window frame for swinging movement from a position of engagement with the window frame to a position standing angularly away from the window frame, said casement being comprised of a light-transmitting material and having at its upper end an opening paralleling the top of the window so that it will be in communication with the interior of the house when the upper sash is lowered and means in the casement for on the one hand absorbing heat from the sun and on the other hand reflecting heat from the sun.

2. The combination according to claim 1 wherein said last-named means is positionable on the one hand to exclude light and on the other hand to admit light.

3. The combination according to claim 1 wherein said last-named means is positionable on the one hand to absorb heat and admit light and on the other hand to reflect heat and admit light.

4. The combination according to claim 1 wherein said last-named means is positionable on the one hand to absorb heat and exclude light and on the other hand to reflect heat and exclude light.

5. The combination according to claim 1 comprising means positioned marginally of the casement at the inner side providing a seal between the window frame and the casement when the latter is in engagement with the window frame.

6. The combination according to claim 1 comprising a flexible sealing material secured to the inner side of the casing peripherally thereof for providing a seal between the window frame and the casement when the latter is in engagement with the window frame, said casement when so positioned constituting a storm window.

7. The combination according to claim 6 wherein the casement is defined by spaced, parallel front and back sides connected to each other at their edges by spaced, parallel top and bottom sides and spaced, parallel sides.

8. The combination according to claim 1 comprising supporting arms at opposite sides of the casing for holding the casing at an angle to the window frame.

9. The combination according to claim 1 comprising means defining skirts attached, respectively, to the window frame and to the casement extendible by movement of the casement to an angular position relative to the window frame to form in conjunction with the window frame and the casement an enclosure.

10. The combination according to claim 9 wherein the enclosure is open at the bottom.

11. The combination according to claim 9 wherein the skirts are detachably attached to the window frame and to the casement.

12. The combination according to claim 1 wherein said last-named means has a heat-absorbing surface on one side and a heat-reflecting surface on the other side and is reversible.

13. The combination according to claim 1 wherein said last-named means comprise reversible slats coated on one side with a heat-absorbent material and on the other side with a heat-reflective material.

14. The combination according to claim 11 wherein said last-named means comprise spaced, parallel slats supported for rotation about horizontal axes for reversal of their opposite sides, said slats having on one side a heat-absorbent surfaceand on the other side a heat-reflecting surface and means for reversing the position of the slats to alternately present one side or the other side outwardly.

15. The combination according to claim 14 wherein the casement has spaced, parallel front and back sides and the slats are positioned in the casement parallel to the front and back sides.

16. The combination according to claim 14 wherein the slats are capable of being positioned at an angle to on the one hand admit light and on the other hand to exclude light.

17. The combination according to claim 14 wherein the slats are capable of being positioned at an angle to absorb heat from the sun and conduct the absorbed heat upwardly in the casing through the top opening into the house.

18. The combination according to claim 1 wherein the last-named means comprise hollow slats coated on one side with heat-absorbent material and on the other side with heat-reflecting material and containing in the one side perforations in communication with the interior thereof.

19. A combination according to claim 1 wherein the last-named means comprise slats having a hollow tubular central section longitudinally thereof and flat fins at the opposite longitudinal sides thereof.

20. A combination according to claim 19 wherein the tubular central section is generally elliptical and the fins are at the narrower sides thereof.

21. A combination according to claim 19 wherein the slats are so arranged that in the closed position the fins of adjacent slats overlap.

22. A combination according to claim 1 wherein the last-named means are slats comprised of sheet metal tubes and flat sheet metal fins attached diametrically to the opposite sides of the sheet metal tubes.

23. A combination according to claim 22 wherein the sheet metal tubes are oval-shaped in cross section and the fins are attached to the apices of the oval.

24. A combination according to claim 18 wherein the heat absorbent side of the hollow slats contain perforations.

25. The combination according to claim 1 wherein said last-named means is a curtain supported in the casing at the top which can be unrolled from top to bottom.

26. The combination according to claim 18 wherein the curtain is comprised of flexible material, one side of which is coated with a heat-absorbent material and the other side of which is coated with a reflective material.

27. The combination according to claim 18 wherein the curtain is comprised of a material which is opaque.

28. The combination according to claim 1 wherein the casing contains a vent opening at the bottom and a closure therefor.

* * * * *